US006328888B1

(12) United States Patent
Hines

(10) Patent No.: US 6,328,888 B1
(45) Date of Patent: Dec. 11, 2001

(54) SKIMMER

(75) Inventor: David W. Hines, Port Colborne (CA)

(73) Assignee: Environment Recovery Equipment Inc., Port Colborne (CA)

( * ) Notice: Subject to any disclaimer, the term of this patent is extended or adjusted under 35 U.S.C. 154(b) by 0 days.

(21) Appl. No.: 09/616,374

(22) Filed: Jul. 13, 2000

(51) Int. Cl.[7] ..... E02B 15/04

(52) U.S. Cl. ..... 210/242.3; 210/526; 210/540; 210/923

(58) Field of Search ..... 210/242.1, 242.3, 210/525, 526, 540, 393, 396, 408, 923

(56) References Cited

U.S. PATENT DOCUMENTS 1,012,974 * 12/1911 Bird ..... 210/393
1,151,999 * 8/1915 Bird ..... 210/393
1,472,574 * 10/1923 Wright et al. ..... 210/396
2,173,256 * 9/1939 Jordan ..... 210/393
3,613,891 * 10/1971 Cloutier ..... 210/242.3
3,834,538 * 9/1974 Laman ..... 210/242.3
4,261,827 * 4/1981 Bronnec ..... 210/242.3
4,336,137 * 6/1982 Byers ..... 210/242.3
5,026,487 * 6/1991 Abdulmassih ..... 210/396
5,183,568 * 2/1993 Lescovich ..... 210/396
5,380,431 * 1/1995 Newsom ..... 210/242.3
5,399,054 * 3/1995 Hines ..... 210/242.3
5,514,265 * 5/1996 Novack et al. ..... 210/396
5,743,694 * 4/1998 Hines ..... 210/242.3

* cited by examiner

*Primary Examiner*—Christopher Upton
(74) *Attorney, Agent, or Firm*—Robert L. Westell

(57) ABSTRACT

A skimmer for operating in a water environment provides a conveyor with transverse apertures and a sloping upwardly travelling lower flight in a trough shaped guide, for a lower extent and, over an upper extent beyond said guide and designed to move material in said upper extent and there to detach material in said apertures.

18 Claims, 5 Drawing Sheets

SKIMMER

Figure 1:
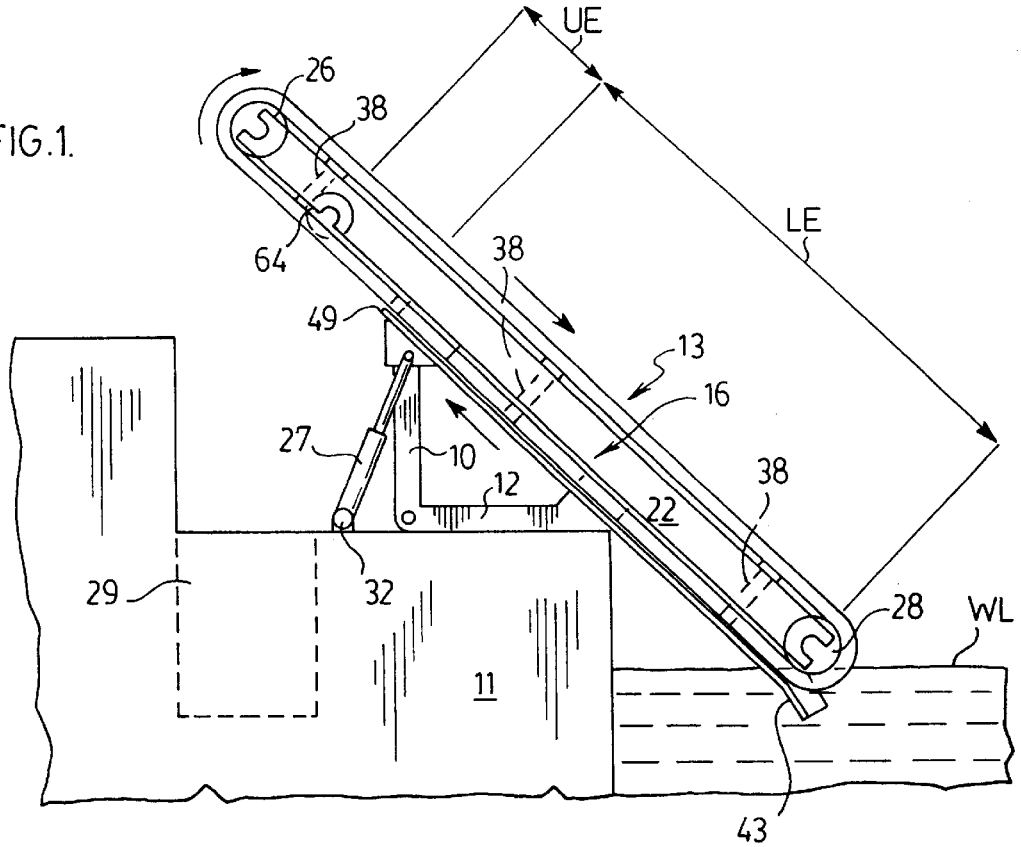

This invention relates to a skimmer for removing a substantial proportion of certain contaminants spilled in a water environment. Contaminants for removal by the invention include oil and particulate bitumen. Particulate bitumen typically, if spilled, is spilled in the form of a mixture of the particulate bitumen in water. The particulate bitumen mixed in water with a surfactant to reduce the viscosity is commonly transported in this form to be used as a fuel supply. The skimmer is useful to remove other noxious and unwanted components. Although the skimmer is particularly useful with heavy oils and heavy contaminants it is also useful with light oils and other types of light, unwanted materials.

By water environment I include: open sea, harbour, lake, bay, sound or other body of water. The water may be fresh or salt.

By particulate bitumen in water is meant bitumen mixed with about 30% water by volume, (or other suitable percentage) in a mixture consisting mainly of bitumen particles. The bitumen particles are heavier than the water and if the bitumen-water mixture is spilled, the bitumen from the mixture soon sinks to become a suspension below the water level or a deposit on the bottom of the water environment. The invention is also particularly adapted to 'skim' oils, water-oil mixtures referred to as 'heavy oils', and some 'medium oils'. Such heavy oil mixtures and some mixtures of the heavier medium oils temporarily float on the surface of a water environment then gradually sink below, or in some cases will immediately sink below the water level. Heavy oil and some medium oil or bitumen particles must therefore be refloated before they may be 'skimmed' by the device of this invention.

By contaminant I include oil, oil mixed with water, particulate bitumen and other unwanted components in a water environment.

Commonly owned U.S. Pat. No. 5,399,054 dated Mar. 21, 1995 and U.S. Pat. No. 5,743,694 dated Apr. 28, 1998 show skimmers of oil in an oil-water mixture having a sloping conveyor where the lower flight of the conveyor is arranged to travel upwardly. The conveyor has apertures therethrough. The conveyor has a lower extent of the lower flight in a trough bounded in section by a bottom wall and opposed side walls. The conveyor lower flight extends upwardly beyond the upper end of the bottom wall to an upper extent. The lower flight lower end is, in use, located just below the water line. The intent of the design is that the skimmed oil water-mixture is caused to travel upwardly with the conveyor walls scraping on the bottom wall to carry the mixture. While the skimmed mixture is travelling up the conveyor, part of the mixture, higher in proportion of water than the skimmed mixture, flows down slope over the conveyor lower flight while the mixture continuing to travel upward with the lower flight is found to be richer in oil than the oil-water mixture in the water environment. Thus it is planned that the conveyor will carry the richer mixture upward on an upper extent of the lower flight, beyond the upper end of the bottom wall, where the conveyor's oil-water mixture is to be dumped in a containment tank. If the spilled contaminant is particulate bitumen (not discussed in the prior patents), water spills down and over the surface of the conveyor lower flight while the bitumen with 'a smaller proportion of water' continues to ride up the upper extent.

The structure and procedure of the skimmer described in the prior, commonly owned patents has worked well. The skimmer of this invention has a similar operating mode but, in a preferred embodiment includes pusher elements which assist in the detachment of heavier liquid components over a collector area. Thus this invention is designed to perform better with contaminants which include highly viscous mixtures or components of mixtures such as heavy and some medium oils and particulate bitumen. Conversely however, the skimmer of this invention works well with light oils of limited viscosity or other light and relatively nonviscous contaminants.

The pusher elements described in the previous paragraph are preferably combined with means for shearing any contaminant hanging from the conveyor over the collector.

By contaminant material I include oil, oil-water mixtures and particulate bitumen and other unwanted material in the water environment.

Accordingly this invention provides a skimmer using an endless conveyor having a pattern of apertures extending transversely herethrough. The conveyor is driven so that the lower flight moves upwardly from a lower end located just below the water line on the outboard end over a lower extent, to an upper extent located over a collector tank or bag. The conveyor flight may thus be considered: as a lower extent where the conveyor lower flight travels on an upward slope over a bottom wall and between two side walls; and an upper extent without the bottom wall and located over the collector tank or bag or other container.

Means are described herein which act during the upward travel of the lower flight over the collection area to insert pusher elements downwardly into the apertures to tend to detach oil-water or bitumen material adhering to the conveyor. This may be adequate to detach the oil-water or bitumen-water material or the majority of it into a collecting container.

However in other applications, the oil-water mixture or bitumen-water mixture will not be fully detached or detached in sufficient quantity.

Thus the conveyor is provided with elements to enter the apertures over the upper extent of its lower flight and push materials in such apertures below the lower edges of the conveyor lower flight over a collector. Some of the contaminant material will fall of its own accord and some will be detached by the pushers to fall into the collector. Other contaminant material, still adhering to the conveyor may be detached by scraping means sometimes called a shear plate riding along lower edges of the conveyor to fall into the collector means.

In the preferred method of providing for the detachment of contaminants described above, an idler push roller is provided above the upper extent of the lower flight shortly before the lower flight starts to curve into the upper. The pusher roll is driven, preferably by the conveyor, and is provided with pusher elements which ride in the conveyor apertures as the pusher roll rotates. The pusher elements preferably serve two purposes. The rotation of the pusher roll is achieved because the conveyor walls defining the apertures contact the pusher elements to turn the idler. At the same time the pusher elements are each dimensioned to push contaminant material in an aperture to a level below the lower surface of the conveyor. A scraper or shear plate may be located to scrape the materials below the conveyor off the conveyor and pusher elements so that the scraped materials fall into the collector.

Thus, preferably, the pusher elements are designed to clear each aperture of contaminant to a large extent. At the same time there must be some clearance between the circumferential spacing of the pusher elements and the longitudinal aperture spacing between transverse walls on the conveyor, to allow rotation of the pusher element rolls (driven by the aperture transverse walls) without interference. The outer surface of each pusher element preferably is a surface of revolution concentric with the axis of the pusher roll. The maximum displacement of the element outer surfaces through the conveyor is preferably a small amount below the lower edges of the conveyor walls defining the aperture, when the element is at maximum depth in an aperture. Thus the tooth tends to push a substantial portion of the contaminant materials downwardly out of the aperture. Most of the materials then adhering to each tooth in the idler gear row are detached by a blade directed to contact the surfaces of revolution approximately tangentially at approximately the maximum depth of the pusher surface of revolution relative to the longitudinal direction of the conveyor lower flight.

Figure 2:
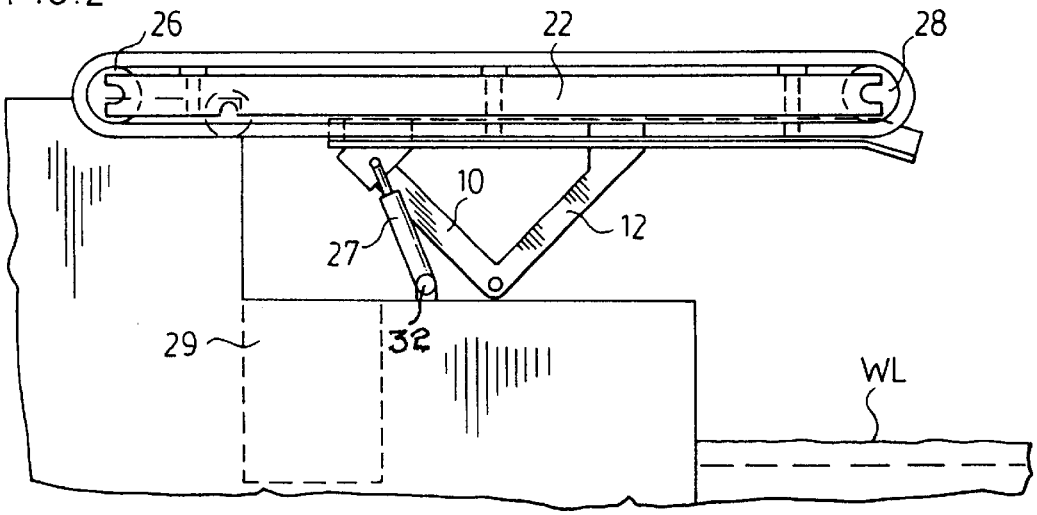
Figure 3:
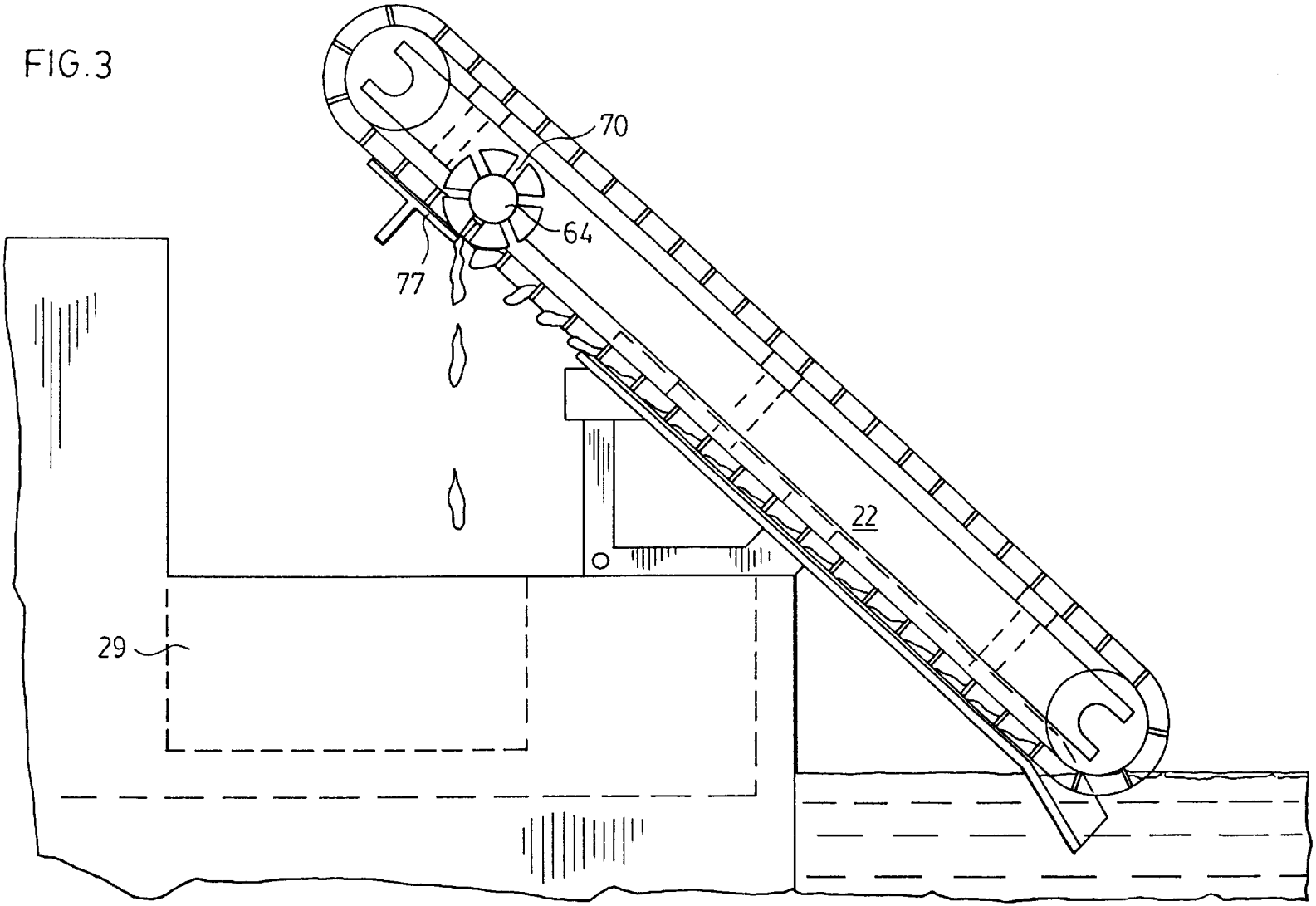
Figure 4:
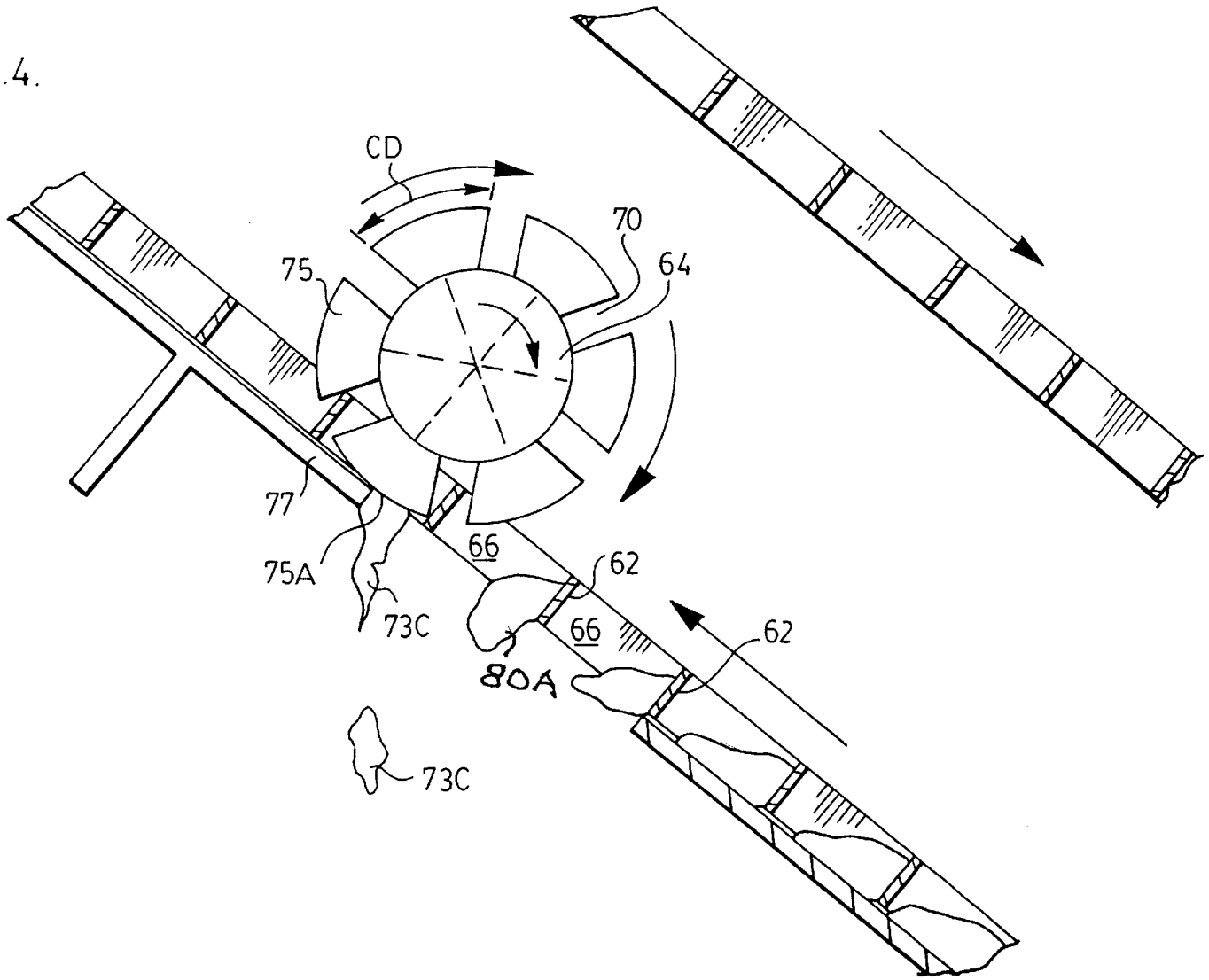
Figure 5:
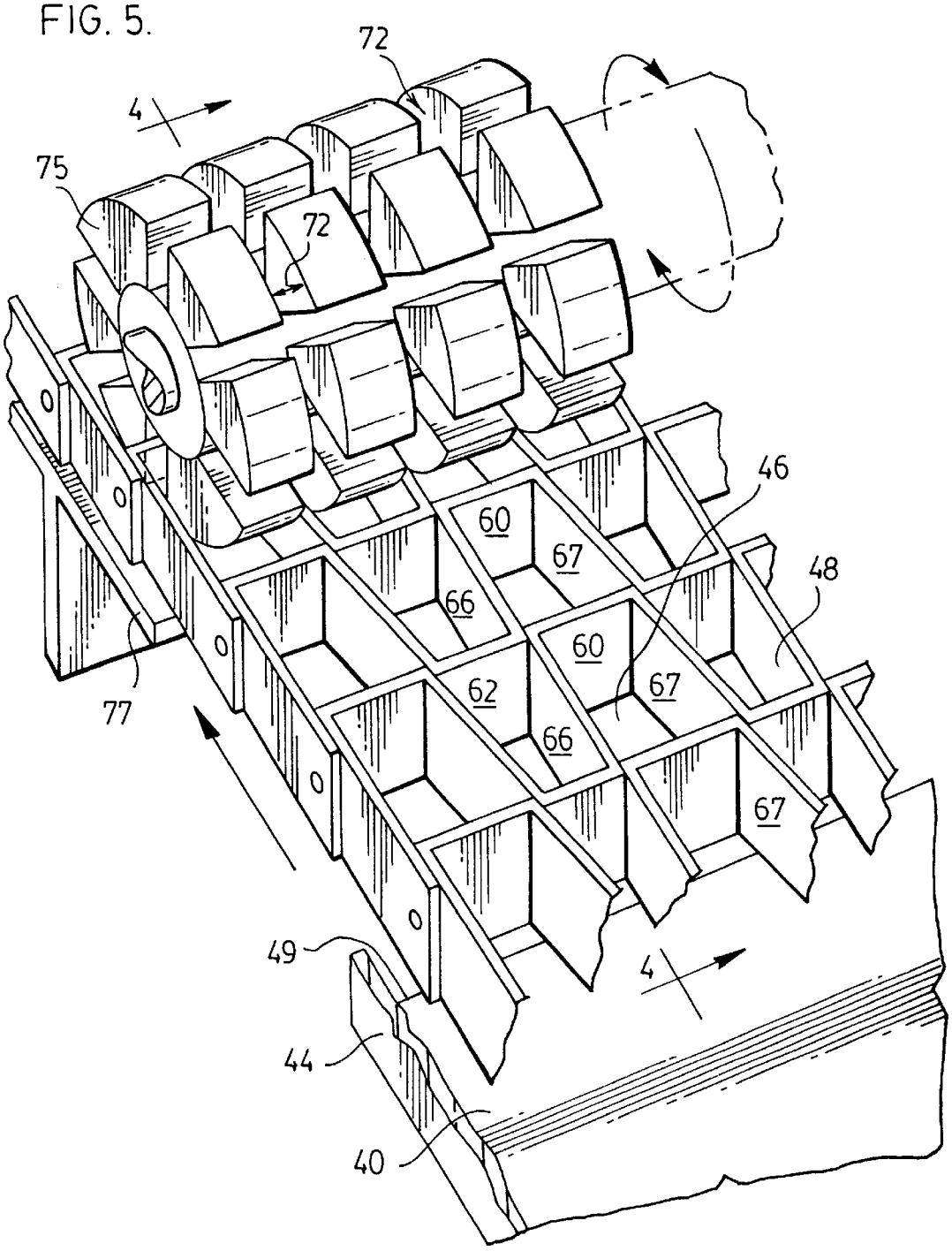
Figure 6:
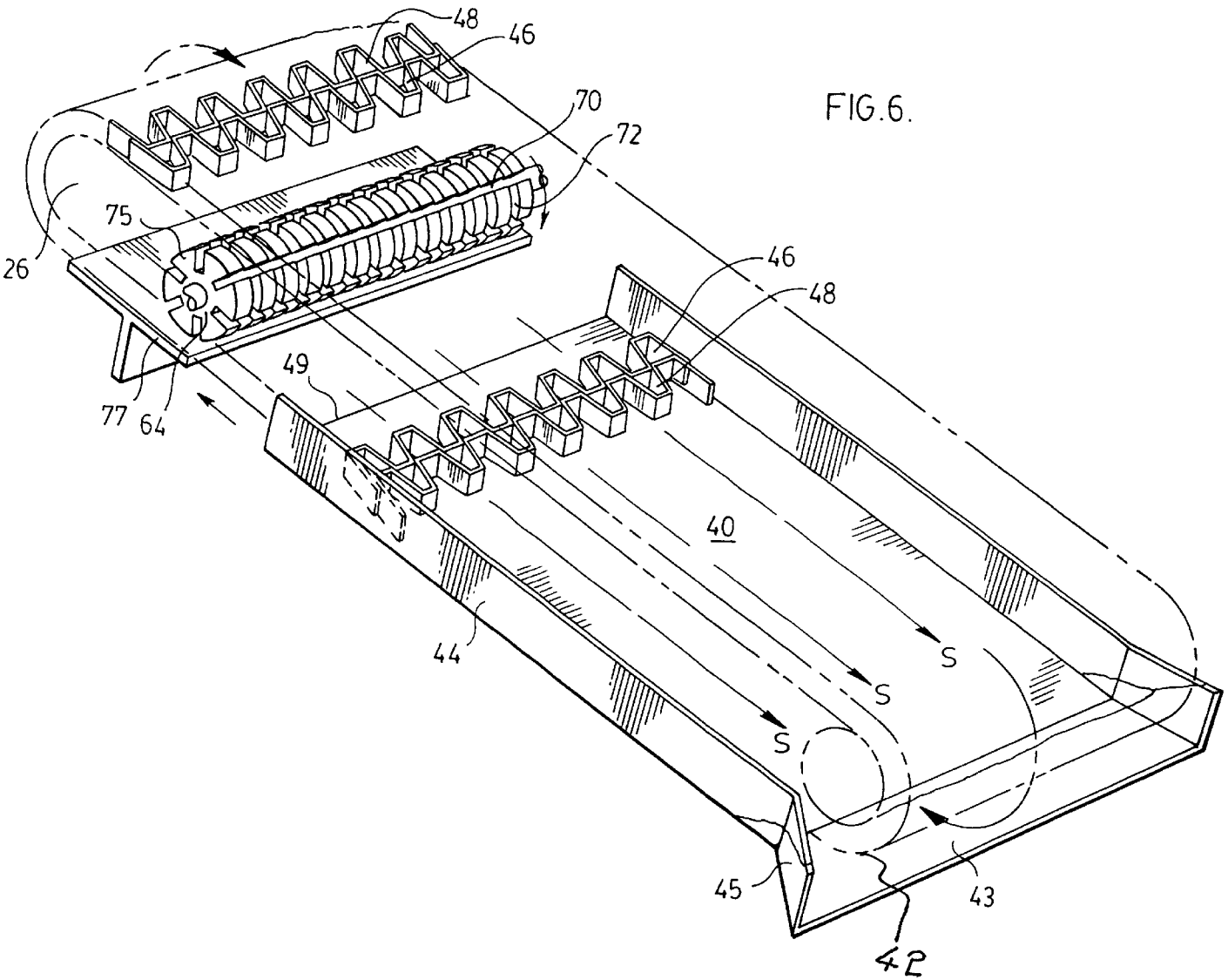

In drawings which illustrate a preferred embodiment of the invention:

FIG. 1 is a schematic side view of the skimmer and mount in use,

FIG. 2 is a side view of the components of FIG. 1 shown in storage position, FIG. 3 is a schematic side view of the conveyor in use showing the relation of the pusher roll, the conveyor and the shear blade, FIG. 4 demonstrates the relation of the pusher roll, the conveyor and the shear blade, FIG. 5 is a partial detail perspective view of the conveyor and the pusher roll; and FIG. 6 is a schematic perspective of the conveyor and pusher roll.

The conveyor 13 and its support frame may be supported on a vessel or on a separate flotation platform. In the drawings a platform 11 supports a main frame 16 on each side by rigidly connected bars 10 and 12 pivotted on each side at pivot 14 on the platform 11. The main frame 16 is bar 22 and an opposed bar (not shown) connected to support the shaft (not shown) of conveyor drive roller 26 at the conveyor's inboard end (upper end in use) and idler roller 28 at the conveyor's outboard end (lower end in use). Inboard of the drive roller 26 the conveyor is driven by a conveyor motor (not shown). The conveyor motor is preferably hydraulically powered by a diesel or gasoline engine. The driven roller 26 by means not shown in detail is coupled to the conveyor, by means not shown in detail, to drive the conveyor so that, in use (in FIG. 1), the lower flight travels upwardly and the upper flight travels downwardly. The lower flight defines the desired angle for raising oil and water or bitumen from the water environment as described hereafter. An hydraulic piston (omitted, for clarity in all but FIGS. 1 and 2) is mounted pivotally at 32 on the platform on the inboard side of pivot 14. The hydraulic piston may be controlled, by means not shown, to cause the conveyor to assume the storage of retracted position (FIG. 2) where the conveyor flights are generally horizontal and the outboard end idler gear 28 is clear of the water level W/L and the use position of FIG. 1 when the conveyor slopes upwardly and the outboard end of the lower flight of the conveyor is below the water level while the inboard end is located over a collector means 29. This may in some installations be a collector tank or a waterproof collection bag or other collector container.

The detailed arrangement of the conveyor will now be described. The frame 16, as directly operated by the piston is connected to cause the main frame to move between active and stored position. Thus frame sides (only 22 is shown) support cross bars 38 extending between them which support the upper conveyor flight clear of the lower. The main frame members 22 by means not shown, support a bottom wall 40 extending between opposed side walls 44 to together form a trough (see FIGS. 5 and 6), which in use is upwardly sloping from the water level. The lower end 43 of the bottom wall preferably slopes or flares downward below the lower end of the conveyor 42 at a greater angle than the remaining conveyor slope, while the side walls at their lower extremity flare outwardly at 45 (see FIG. 6), to define the entrance way for the entrance of environmental water to the lower end of the conveyor.

The conveyor forms an open mesh screen with a pattern of apertures 46 and 48 (see FIGS. 5 and 6). Its walls 60 and 62 run transverse to the conveyor direction and are approximately perpendicular to the trough bottom 40 and act as a plough or dam and carry water and oil or water and bitumen up the conveyor slope. The conveyor mesh also provides surfaces 67 and 66 nearly parallel to the direction of conveyor travel and perpendicular to the trough bottom and which tend, with surfaces 60 and 62 to form upwardly facing apertures 66 for the water and contaminant. Such apertures need not be in a square array but may be staggered in other conveyor arrangements. However transverse aperture rows seem best to intermesh with transverse rows of pusher roller pusher elements. It should be clearly understood that some leakage between the bottom of walls 60, 62, 66, 67 and bottom wall 40 is expected and, in some mesh arrangements there may be leakage between surfaces 60 and 62. However, the lower conveyor flight does move a substantial proportion of the water and contaminant up the conveyor path.

In the rising of the conveyor different phenomena occur depending on the contaminant. Running back down the conveyor is liquid in the direction S as the remaining contaminant and water is carried by the conveyor above the upper edge of the trough bottom for removal into a collector. If the contaminant was a mixture of particulate bitumen and water, then the liquid running back down the conveyor and over the sides is substantially pure water so that what goes with the conveyor over the collector is bitumen and any remaining water. If the contaminant was a mixture of oil and water the liquid running back down the conveyor is a mixture with more water than in the water environment and the liquid carried toward the upper conveyor extent is higher in oil content than in the water environment.

With the heavy and (some) medium oils and with the bitumen-water mixture, the materials carried by the conveyor lower flight over the collection area are often of such viscosity that a large proportion of such materials clings to the conveyor rather than fall by gravity alone, into the collector. There will then be provided for detachment of the materials the pusher roll and usually also the shear blade to be later described.

The mesh of the container is preferably articulated metal screening with cavities having maximum dimensions in the plane of the lower flight of between three quarters of an inch (¾") and four inches (4").

I prefer to use cell mesh as shown best in FIG. 5 with maximum width and length dimensions each of between ¾" and 4". The thickness of the flight, and hence of individual apertures which in accord with the invention corresponds to the height of the transverse and longitudinal walls acting as 'dams' raising the water contaminant mixture is preferably between ¼" and 1½".§

For many oil and water mixtures the mesh sizes given in commonly owned U.S. Pat. No. 5,743,694 at Col. 3 line 51 to Col. 4 line 12 are suitable and are incorporated herein by reference.

However for the heavy and some medium oils, and with the particulate bitumen mixture with which this application is substantially concerned are the conveyor apertures given their shown shape preferably approximately 1" square and the longitudinal and transverse walls are about ¾" deep.

Although a conveyor may be used where the cavities are not in transverse rows it will be obvious when the preferred embodiment is discussed, that the idler pusher roll appears easier to construct and to design for operation in co-operation with the mesh with apertures in rows parallel to the plunger idler roll axis and transverse to the conveyor longitudinal direction.

Thus in the 'active' attitude of the conveyor the bottom wall 40 of the lower conveyor flight terminates at 49 short of the upper end of the conveyor lower flight as shown coinciding with the lower extent LE. Thus the materials carried upward by the conveyor inboard past the inboard edge 49 of the bottom wall 40 over the open-bottomed upper extent UE may, if liquid, fall into the collection tank or bag 29 (FIGS. 1, 2 and 3). The idler plunger roll 64 is provided to detach from the conveyor, materials adhering to the mesh as they pass over the collector so that they also fall into the collector means.

The preferred idler plunger roll 64 is provided with circumferential grooves 70 which will be used to receive the lengthwise members 67, and 66 forming the conveyor aperture. The idler teeth 75 are then formed by cutting axially extending grooves 70 in the roller surface. These are cut to receive the transverse walls 60 or 62 of the mesh. It will be readily seen that this construction step requires that the walls 60 and 62 be approximately aligned across the conveyor. The grooves 70 are however made wider than required to receive the walls 60 and 62 to provide a large tolerance between the longitudinal spacing of the corresponding sets successive conveyor transverse walls 60 or 62 (62 is shown) and the circumferential dimension CD of the pusher teeth. The teeth dimensions are therefore selected so that successive transverse walls 60 or successive transverse walls 62, spaced lengthwise along the conveyor enter preferably successive transverse (axial relative to the pusher roll) grooves 70. Thus the travel of the conveyor causes the walls 60 or 62 to move upwardly and contact the sides of pusher elements 75 and thereby rotate the pusher idler roll. The elements 75 are designed to enter a conveyor aperture to a depth just beyond the remote edges of the conveyor (the lower in the lower flight) (see FIG. 4). In doing so adhering materials are detached or tend to cling to the outside of the teeth surfaces.

It is noted that, in the preferred container design, the longitudinally extending (relative to the conveyor) walls 67 or 66 which collectively form a longitudinally extending cavity wall are slightly differing from longitudinal in order to provide for an overlap. Thus the pusher roll must have circumferential grooves 70 sufficiently wide to receive the overlapped walls 62, 60.

The pusher elements 75 are preferably of a length to just pass the lower wall edges of the upwardly travelling lower flight (see 75A). Thus materials 80A clinging to the conveyor lower flight tend to be pushed downward by the pusher teeth and then may as material 73C fall from the conveyor.

A shear blade 77 mounted by means, not shown, on the main frame is located to contact said respective outside surfaces of teeth (see 75A) on the latter's movement through that tooth's maximum projection into an aperture position and under upward movement of the conveyor lower flight. The blade 77 detaches more of the material 73C for deposit in the collector tank or collection bag. It is found that the petroleum or bitumen based material has enough buoyancy that a waterproof bag of said material is floatable in the water environment from the vicinity of the skimmer to a receptacle.

The pusher roller is shown with transverse (parallel to the pusher roll axis) grooves 70 having parallel sides. This is because the easiest way of making such grooves is transverse saw and router cuts. However there is no functional requirement for parallel sided grooves 70 and if a different method of manufacture is used the teeth and grooves may be differently shaped. The principal functional requirements are that the teeth (as shaped by the grooves 70 and 72) may be driven by the conveyor and respective teeth enter groove apertures to push materials therein downward.

What is claimed is:

1. In a skimmer having a conveyor mountable to provide in the conveyor travel direction an upwardly sloping lower flight, said conveyor comprising a pattern of apertures extending through the conveyor, said lower flight having a lower extent defining a section bounded by side and bottom walls, with the bottom wall terminating short of an upper extent of the lower flight, a collector for materials dropping off the upper extent of the conveyor lower flight, the improvement comprising means along the upper extent for mechanically pushing downward on materials in said apertures.

2. In a skimmer as claimed in claim 1 wherein a shear surface is located to be impacted by materials located below the upper extent of said conveyor lower flight and travelling therewith, whereby to tend to detach said material from said conveyor.

3. In a skimmer having a conveyor mountable to provide in the conveyor travel direction an upwardly sloping lower flight, said conveyor comprising a pattern of apertures extending through the conveyor extent, said lower flight having a lower extent defining a section bounded by side and bottom walls, with the bottom wall terminating short of the upper end of the lower flight, to define thereabove a conveyor upper extent on the lower flight, a collector for material dropping off the upper extent of the conveyor lower flight, the improvement comprising means for downwardly inserting elements in said apertures during travel of said apertures along said upper extent.

4. In a skimmer as claimed in claim 3 wherein a shear surface is located to be impacted by materials located below the upper extent of said conveyor lower flight and travelling therewith, whereby to tend to detach said material from said conveyor.

5. In a skimmer having a conveyor mountable to provide a sloping lower flight, upwardly moving, said conveyor comprising a pattern of apertures extending in rows which rows are perpendicular to the conveyor extent, said lower flight having a lower extent defining a section bounded by side and bottom walls, with the bottom wall terminating short of the upper end of the lower flight, to define thereabove an upper extent of said lower flight, a collector for material dropping off the conveyor lower flight in upper extent, a roller for location above said upper extent contoured to provide an array of elements adapted to enter said apertures from above.

6. A skimmer as claimed in claim 5 wherein said elements are dimensioned to enter said apertures to the approximate depth thereof.

7. A skimmer as claimed in claim 6 wherein said roller is actuated by movement of said conveyor.

8. In a skimmer as claimed in claim 7 wherein a shear surface is located to be impacted by materials located below the upper extent of said conveyor lower flight and travelling therewith, whereby to tend to detach said material from said conveyor.

9. A skimmer as claimed in claim 6 wherein said roller is driven by said conveyor acting on said elements.

10. In a skimmer as claimed in claim 9 wherein a shear surface is located to be impacted by materials located below the upper extent of said conveyor lower flight and travelling therewith, whereby to tend to detach said material from said conveyor.

11. In a skimmer as claimed in claim 6 wherein a shear surface is located to be impacted by materials located below the upper extent of said conveyor lower flight and travelling therewith, whereby to tend to detach said material from said conveyor.

12. A skimmer as claimed in claim 5 wherein said roller is actuated by movement of said conveyor.

13. In a skimmer as claimed in claim 12 wherein a shear surface is located to be impacted by materials located below the upper extent of said conveyor lower flight and travelling therewith, whereby to tend to detach said material from said conveyor.

14. A skimmer as claimed in claim 5 wherein said roller is driven by said conveyor acting on said elements.

15. In a skimmer as claimed in claim 14 wherein a shear surface is located to be impacted by materials located below the upper extent of said conveyor lower flight and travelling therewith, whereby to tend to detach said material from said conveyor.

16. In a skimmer as claimed in claim 5 wherein a shear surface is located to be impacted by materials located below the upper extent of said conveyor lower flight and travelling therewith, whereby to tend to detach said material from said conveyor.

17. In a skimmer having an endless conveyor with walls defining apertures therethrough, a lower flight travelling on an upward slope, and having a lower and an upper extent, said lower extent travelling in a trough shaped guide having a bottom, said upper extent extending over a length beyond said bottom, mechanical pusher elements for extending downwardly into said apertures when the latter are beyond said bottom.

18. In a skimmer as claimed in claim 17 wherein a shear surface is located to intercept material below said upper extent beyond said bottom.

* * * * *